US009124059B2

(12) United States Patent
Dong et al.

(10) Patent No.: US 9,124,059 B2
(45) Date of Patent: Sep. 1, 2015

(54) RECEPTACLE HAVING AN INSULATOR WITH INSERT-MOLDED CONTACTS AND SURROUNDED BY A METALLIC SHELL

(71) Applicant: ADVANCED-CONNECTEK INC., Taipei (TW)

(72) Inventors: Fei-Wu Dong, Taipei (TW); Wei Wan, Taipei (TW); Shu-Lin Duan, Taipei (TW); Ching-Tien Chen, Taipei (TW)

(73) Assignee: ADVANCED-CONNECTEK INC., Taipei (TW)

( * ) Notice: Subject to any disclaimer, the term of this patent is extended or adjusted under 35 U.S.C. 154(b) by 0 days.

(21) Appl. No.: 14/063,538

(22) Filed: Oct. 25, 2013

(65) Prior Publication Data

US 2014/0120781 A1 May 1, 2014

(30) Foreign Application Priority Data

Oct. 26, 2012 (CN) ..... 2012 1 0414309
Oct. 26, 2012 (CN) ..... 2012 2 0552663 U

(51) Int. Cl.

| | |
|---|---|
| ***H01R 24/00*** | (2011.01) |
| ***H01R 43/20*** | (2006.01) |
| ***H01R 12/50*** | (2011.01) |
| *H01R 13/41* | (2006.01) |
| *H01R 13/502* | (2006.01) |
| *H01R 24/62* | (2011.01) |

(52) U.S. Cl.

CPC ..... *H01R 43/20* (2013.01); *H01R 23/7063* (2013.01); *H01R 23/7073* (2013.01); *H01R 13/41* (2013.01); *H01R 13/502* (2013.01); *H01R 24/62* (2013.01)

(58) Field of Classification Search

CPC ..... H01R 23/725; H01R 23/7073; H01R 13/629; H01R 13/642; H01R 13/658
USPC ..... 439/660, 677, 607.35
See application file for complete search history.

(56) References Cited

U.S. PATENT DOCUMENTS

| | | | | |
|---|---|---|---|---|
| 7,695,318 | B1 * | 4/2010 | Wang et al. | 439/607.01 |
| 7,794,284 | B1 * | 9/2010 | He et al. | 439/660 |
| 8,202,120 | B2 * | 6/2012 | Ko | 439/607.35 |
| 8,333,614 | B2 * | 12/2012 | Xiong et al. | 439/660 |
| 8,790,138 | B2 * | 7/2014 | Wang et al. | 439/660 |

* cited by examiner

*Primary Examiner* — Chandrika Prasad
(74) *Attorney, Agent, or Firm* — Rabin & Berdo, P.C.

(57) ABSTRACT

A Mini DisplayPort connector receptacle including an insulator, a plurality of contacts and a metal shell surrounding the insulator. The insulator includes a first insulator and a second insulator with a base portion, a positioning portion, and a tongue plate. The tongue plate defines first contact locations on a top side of the tongue plate and second contact locations on a bottom side of the tongue plate. The contacts include upper contacts at the corresponding first contact location and lower contacts at the corresponding second contact location. The connection portions of the lower contacts are held by the base portion and insert-molded in the base portion, and the partial soldering portions of the lower contacts are held by the positioning portion and insert-molded in the positioning portion.

11 Claims, 9 Drawing Sheets

RECEPTACLE HAVING AN INSULATOR WITH INSERT-MOLDED CONTACTS AND SURROUNDED BY A METALLIC SHELL

CROSS-REFERENCES TO RELATED APPLICATIONS

This non-provisional application claims priority under 35 U.S.C. §119(a) on Patent Application No. 201210414309.6 and 201220552663.0, both filed in China, P.R.C. on 2012/10/26, the entire contents of which are hereby incorporated by reference.

BACKGROUND

1. Technical Field

The present invention relates to a connector receptacle, and particularly to a Mini DisplayPort connector receptacle in which the insulator of the Mini DisplayPort connector receptacle includes a positioning portion capable of guiding soldering portions of the contacts of the Mini DisplayPort connector receptacle to be inserted into the corresponding through holes defined in a circuit board.

2. Related Art

As technology continues to develop, various electronic devices are invented regularly. In order to transmit the signals of electronic devices, connector receptacles are also necessary.

Displayport is a digital display interface developed by Video Electronics Standards Association, applied to connect computers with monitors or home theater systems and capable of replacing the conventional analog transmitting interfaces (namely, VGA), and the conventional digital transmitting interfaces (that is, DVI). Additionally, some companies publish mini-sized Displayports called Mini Displayports, which can support VGA and DVI interfaces with adapters, and are mainly applied to Mac notebooks.

Please refer to FIG. 1, which is an exploded view of a conventional connector receptacle 10. As shown in FIG. 1, the conventional connector receptacle 10 can be mated with a connector plug (not shown). The conventional connector receptacle 10 has the Mini Displayport interface and includes an insulator 11, a plurality of contacts 16, a metal shell 17 and an organizer 15. The insulator 11 substantially consists of a first insulator 12 and a second insulator 13, and includes a plurality of contact grooves 14. The contacts 16 are inserted into the contact grooves 14 of the insulator 11. The metal shell 17 surrounds the insulator 11. The organizer 15 is assembled with the insulator 11 with a plurality of holes 151 for passing the soldering portions of the contacts 16.

Upon assembly, the contacts 16 of the conventional connector receptacle 10 are assembled in the contact grooves 14 of the insulator 11; the holes of the organizer 15 are then provided to receive the contacts 16 and fasten the positions of the contacts 16; in this way, the metal shell 17 surrounds the insulator 11; as a result, the assembling of the conventional connector receptacle 10 is achieved.

However, although the holes 151 can fasten the positions of the contacts 16 to ensure the contacts 16 match the connecting regions on the circuit board, the transmitting signals are unstable, due to the gaps existed between the holes 151 and the contacts 16.

SUMMARY

In view of this, the present invention provides a connector receptacle including an insulator, a plurality of contacts and a metal housing shell. The insulator includes a base portion, a positioning portion and a tongue plate. The positioning portion extends backwardly from the base portion in a front-to rear direction, and the tongue plate extends forwardly from the base portion in a rear-to-front direction. The tongue plate defines a plurality of contact locations which define first contact locations disposed on a top side of the tongue plate and second contact locations disposed on a bottom side of the tongue plate. The plurality of contacts includes a plurality of upper contacts and a plurality of lower contacts in which each contact portion of the upper contacts is located at the corresponding first contact location and each contact portion of the lower contacts is located at the corresponding second contact location. The connection portions of the upper contacts are held by the first insulator and insert-molded in the first insulator, the connection portions of the lower contacts are held by the base portion and insert-molded in the base portion, and the partial soldering portions of the lower contacts are held by the positioning portion and insert-molded in the positioning portion such that the soldering portions of the lower contacts are guided to be inserted into the corresponding through holes defined in the circuit board. The metal shell surrounds the insulator.

In one preferred exemplary embodiment, the insulator includes a base portion, a tongue plate and a positioning portion which are integrally injection molded or the like for production of an unitary member.

In one preferred exemplary embodiment, the soldering portions of the upper contacts are mounted or placed directly onto the surface of the circuit board by the surface mount technology (SMT) and the soldering portions of the lower contacts are secured to a printed circuit board by inserting the soldering portions of the first set of lower soldering portions and the soldering portions of the second set of lower soldering portions through holes in the board and soldering them in place by the through hole technology.

In one preferred exemplary embodiment, the connector receptacle has the Mini Displayport interface.

The detailed features and advantages of the disclosure are described below in great detail through the following embodiments; the content of the detailed description is sufficient for those skilled in the art to understand the technical content of the disclosure and to implement the disclosure there accordingly. Based on the content of the specification, the claims, and the drawings, those skilled in the art can easily understand the relevant objectives and advantages of the disclosure.

BRIEF DESCRIPTION OF THE DRAWINGS

The disclosure will become more fully understood from the detailed description given herein below for illustration only and thus not limitative of the disclosure, wherein.

DETAILED DESCRIPTION

Figure 1:
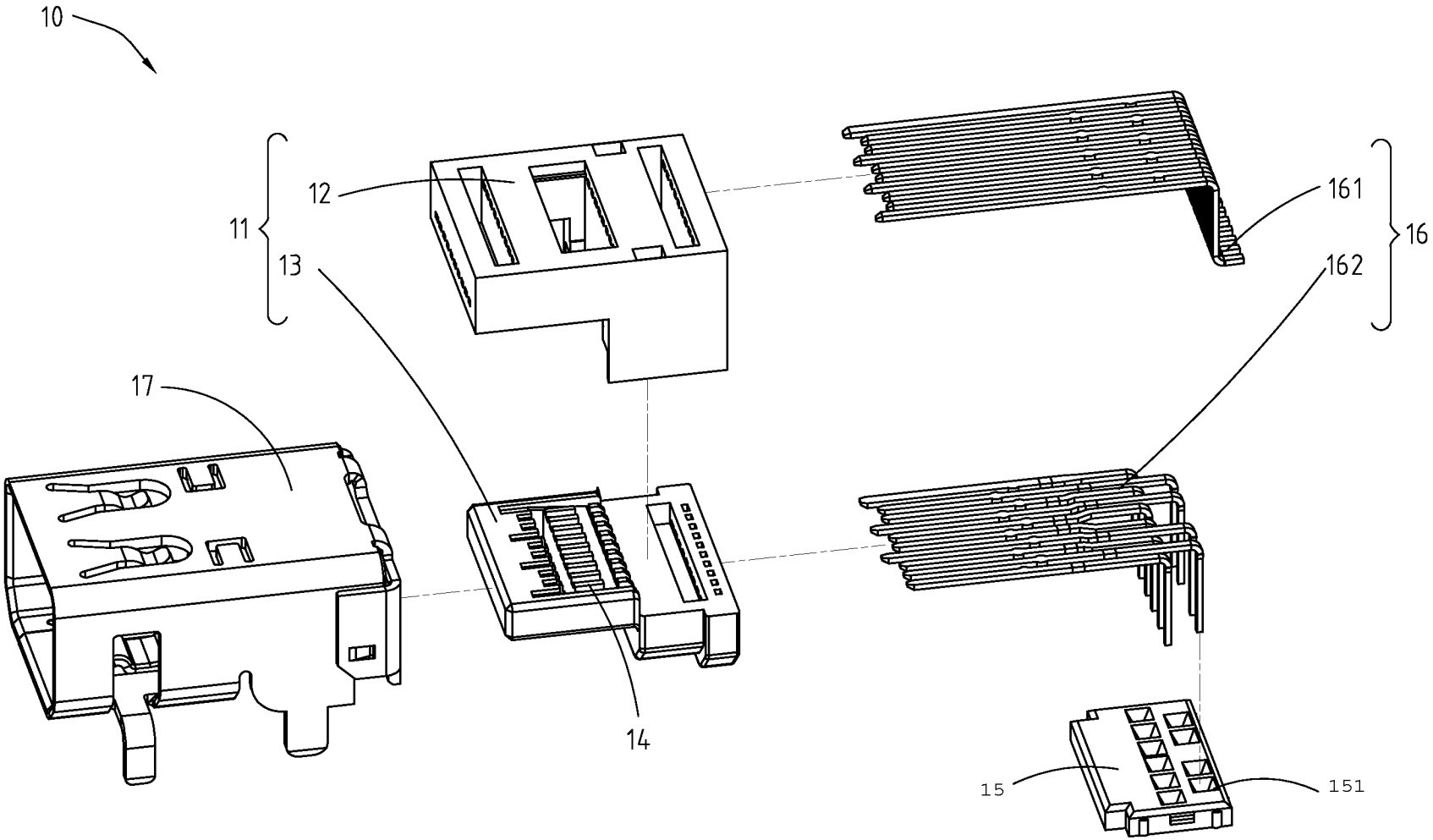
FIG. 1(Prior Art)
FIG. 1 is an exploded view of a conventional connector receptacle.
Figure 2:
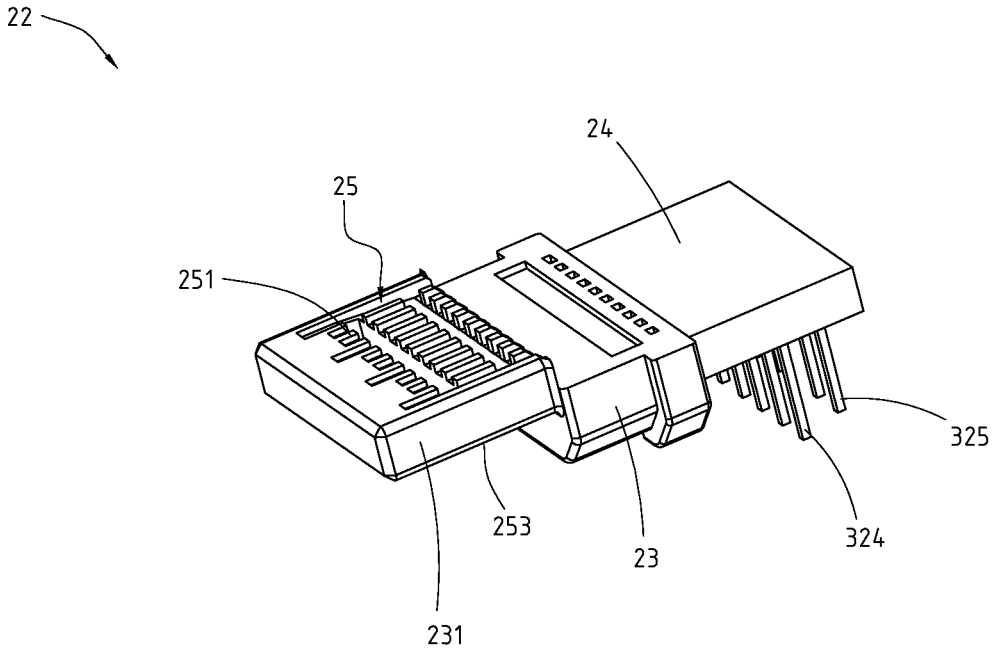
FIG. 2 is a perspective view of where a metal shell is eliminated from the connector receptacle and formed in a first exemplary embodiment according to the present invention.
Figure 3:
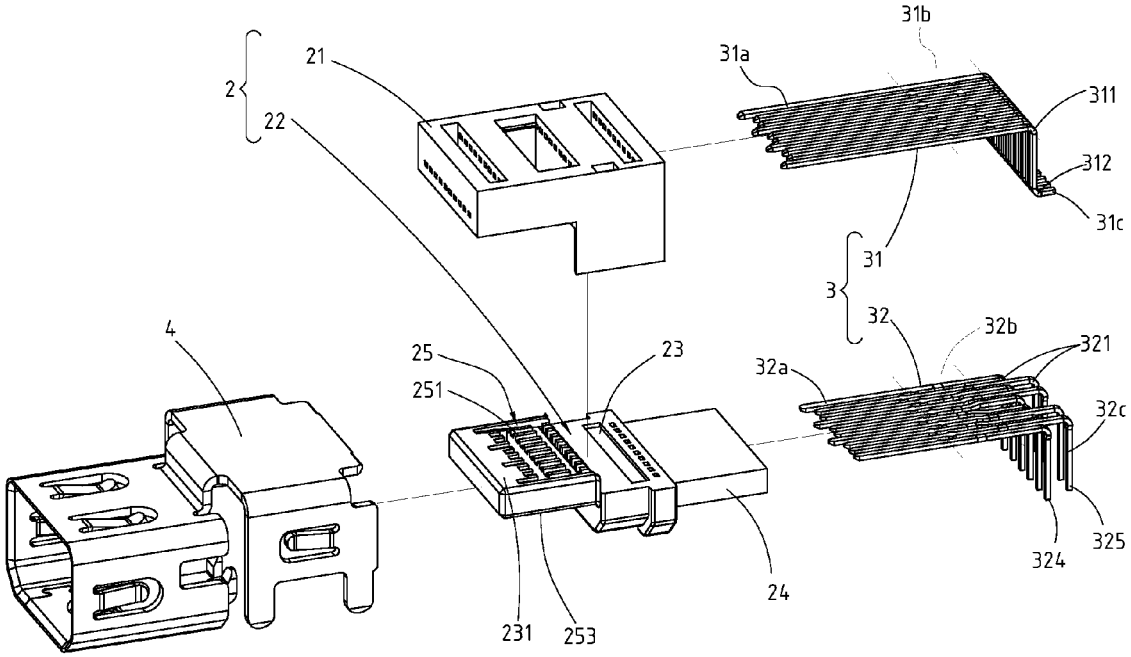
FIG. 3 is an exploded view of the connector receptacle formed in the first exemplary embodiment according to the present invention.

Please refer to FIG. 2 and FIG. 3, which are a perspective view of a connector receptacle 20 of a first exemplary embodiment according to the present invention and an exploded view of the connector receptacle 20 of the first exemplary embodiment according to the present invention respectively. As shown in FIG. 2 and FIG. 3, the connector receptacle 20 can be mated with a predefined connector plug (not shown) to form connections. The connector receptacle 20 can have the Mini Displayport interface and includes an insulator 2, a plurality of contacts 3 and a metal shell 4.

The insulator 2 includes a first insulator 21 and a second insulator 22. The second insulator 22 includes a base portion 23, a tongue plate 231 and a positioning portion 24. The tongue plate 231 is thinner than the base portion 23 and extends forwardly from the base portion 23 in the rear-to-front direction. The positioning portion 24 extends backwardly from the base portion 23 in the front-to-rear direction. The tongue plate 231 defines a plurality of contact locations 25. The plurality of contact locations 25 further defines first contact locations 251 disposed on a top side of the tongue plate 231 and second contact locations 253 disposed on a bottom side of the tongue plate 231. The second contact locations 253 also pass through the base portion 23 and the positioning portion 24. For example, the base portion 23, the tongue plate 231 and the positioning portion 24 may be integrally injection molded or the like for production of an unitary member.

In this embodiment, the plurality of contacts 3 include a plurality of upper contacts 31 and a plurality of lower contacts 32. Each of the upper contacts 31 includes a contact portion 31*a*, a connection portion 31*b*, and a soldering portion 31*c*. Each of the lower contacts 32 includes a contact portion 32*a*, a connection portion 32*b*, and a soldering portion 32*v*. The connection portions 31*b* of the upper contacts 31 are held by the first insulator 21 and insert-molded in the first insulator 21. Each of the contacts 31 includes a first upper bending portion 311 and a second upper bending portion 312 at the soldering portion 31*c*. The soldering portions 31*c* of the upper contacts 31 use surface-mount contacts for the mating interface. The connection portions 32*v* and the partial soldering portions 32*c* of the lower contacts 32 are held by the second insulator 22 and insert-molded in the second insulator 22. In other words, the connection portions 32*b* of the lower contacts 32 are held by the base portion 23 and insert-molded in the base portion 23 and the partial soldering portions 32*c* of the lower contacts 32 are held by the positioning portion 24 and insert-molded in the positioning portion 24. Each of the lower contacts 32 includes a first lower bending portion 321. The plurality of lower contacts 32 also includes two parallel rows of electrical soldering portions, named as a first set of lower soldering portions 324 and a second set of lower soldering portions 325. Preferably, the soldering portions 31*c* of the upper contacts 31 and the lower contacts 32 are secured to a printed circuit board by inserting the soldering portions 32*b* of the first set of lower soldering portions 324 and the soldering portions 32*b* of the second set of lower soldering portions 325 through holes in the board and soldering them in place by through hole technology.

The metal shell 4 surrounds the insulator 2. The tongue plate 231 can be a type of insulator core, where a cavity (space) surrounds the insulator core between the insulator core and the shell, thereby forming the tongue plate 231.

It is to be understood that in the first exemplary embodiment, the first insulator 21 and the second insulator 22 are coupled into a single unit to form the insulator 2. When the first insulator 21 and the second insulator 22 are coupled into a single unit to form the insulator 2, the contact portions 31*a* of the upper contacts 31 are located at the first contact locations 251 disposed on the top side of the tongue plate 231 and the contact portions of the lower contacts 32 are located at the second contact locations 253 disposed on the bottom side of the tongue plate 231. Preferably, the insulator 2 may be integrally injection molded or the like for production of a unitary member (not shown), that is, the main body 21 and the second insulator 22 are formed integrally as a whole the number of the bending portion is not limited by the disclosure.

When the first insulator 21 and the second insulator 22 are coupled into a single unit to form the insulator 2, the upper contacts 31 are preferably located at contact locations 25 disposed on the top side of the tongue plate 231 and the lower contacts 32 are preferably located at the contact locations 25 disposed on the bottom side of the tongue plate 231 via an insert-molding process, and the metal shell 4 is provided to surround the insulator 2, thereby completing the assembly of the connector receptacle 20. Due to the positioning portion 24 extending backwardly from the base portion 23 of the insulator 2, and plurality of contact locations 25 passing through the base portion 23 and the positioning portion 24, the contacts 3 are aligned by the positioning portion 24, so that the soldering portions of the contacts 3 can be guided to be easily inserted into the corresponding through holes defined in the circuit board, thereby stabilizing the signal transmission quality of an electronic device and meeting the requirements for signal behavior.

Additionally, the organizer 15 applied in the conventional connector receptacle 10 is not applied in the disclosure, thereby reducing both the difficulty of the manufacturing processes, and the manufacturing costs.

Furthermore, the modularized design of the disclosure aids the communication between different electronic devices. In addition, the manufacturer can develop customized Mini DisplayPort receptacles 20 according to customer requirements, with minimal costs.

Figure 4:
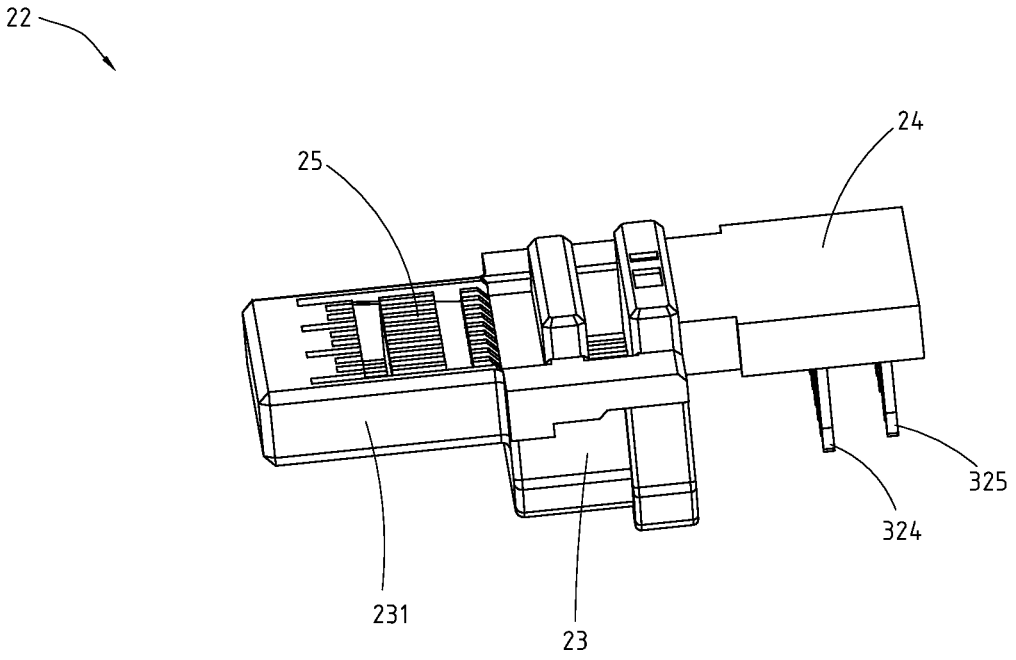
FIG. 4 is a perspective view of a connector receptacle where a metal shell is eliminated from the connector receptacle and formed in a second exemplary embodiment according to the present invention.
Figure 5:
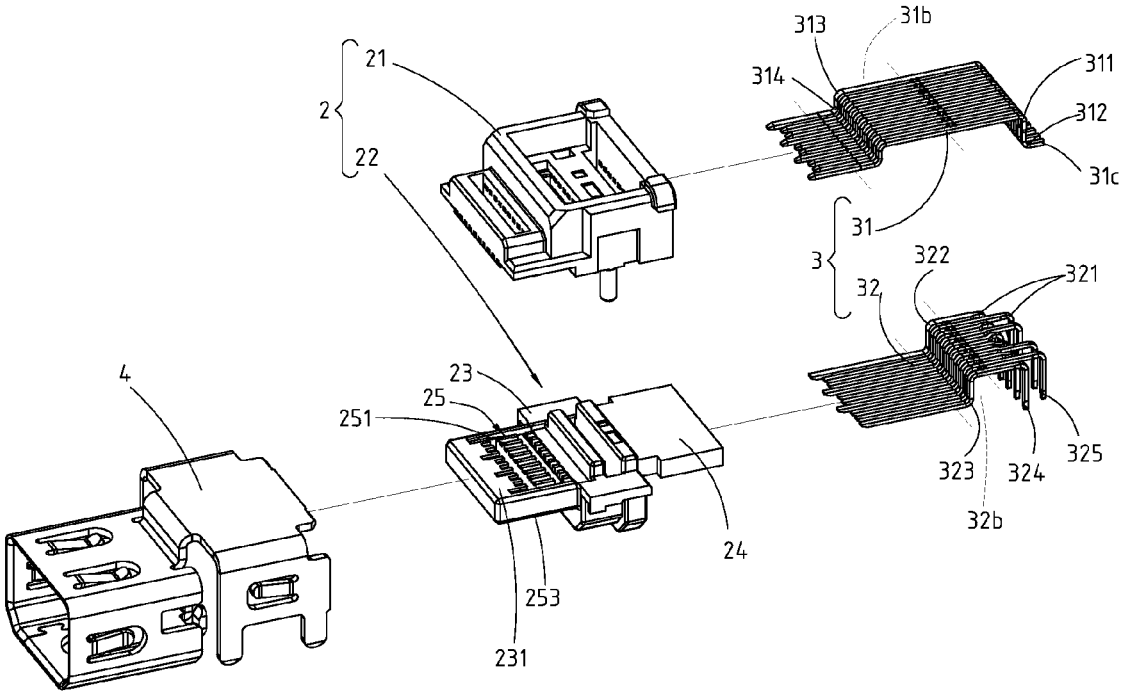
FIG. 5 is an exploded view of the connector receptacle formed in the second exemplary embodiment according to the present invention.

Please refer to FIG. 4 and FIG. 5, which are a perspective view of a connector receptacle 20 formed in a second exemplary embodiment and an exploded view of the connector receptacle 20 formed in the second exemplary embodiment according to the present invention. As shown in FIG. 4 and FIG. 5, the connector receptacle 20 of this second exemplary embodiment is approximately the same as that of the first embodiment, except that in the second exemplary embodiment each of the upper contacts 31 further includes a third upper bending portion 313 and a fourth upper bending portion 314 at the connection portion 31*b*, and each of the lower contacts 32 further includes a second lower bending portion 322 and a third lower bending portion 323.

Figure 6:
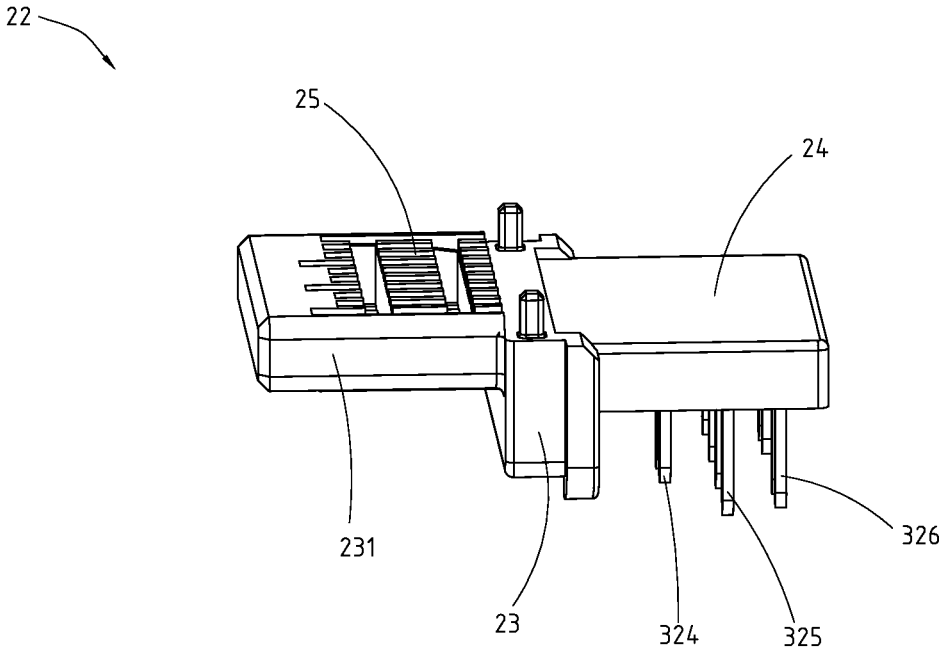
FIG. 6 is a perspective view of a connector receptacle where a metal shell is eliminated from the connector receptacle and formed in a third exemplary embodiment according to the present invention.
Figure 7:
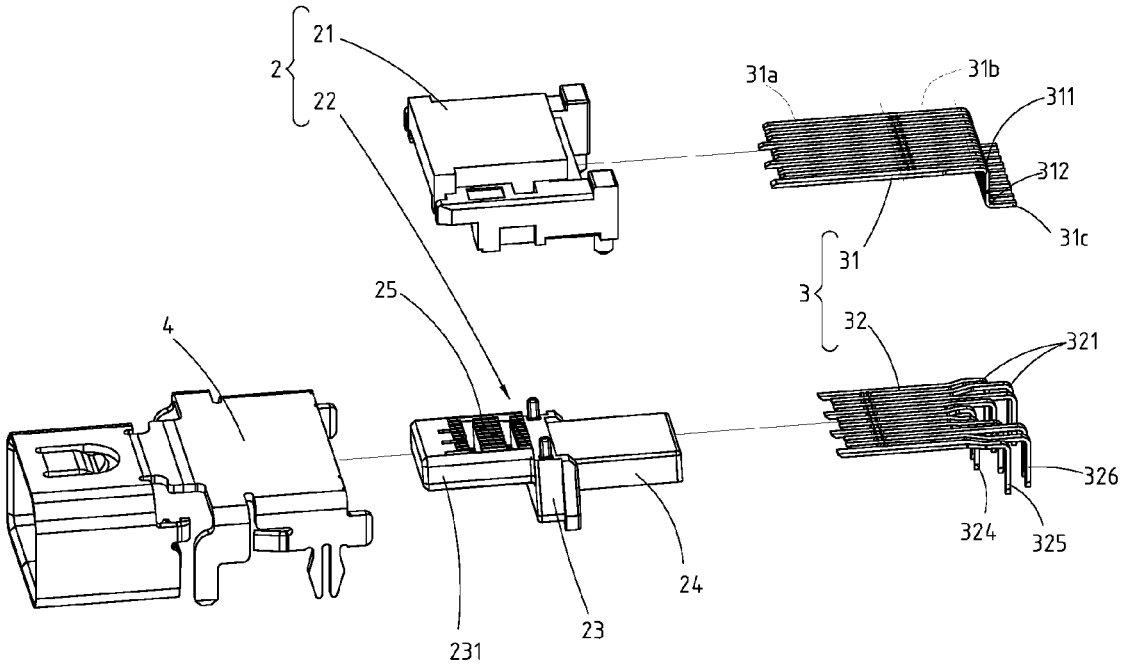
FIG. 7 is an exploded view of the connector receptacle formed in the third exemplary embodiment according to the present invention.

Please refer to FIG. 6 and FIG. 7, which are a perspective view of a connector receptacle 20 formed in a third exemplary embodiment and an exploded view of the connector receptacle 20 formed in the third embodiment. As shown in FIG. 6 and FIG. 7, the connector receptacle 20 of this embodiment is approximately the same as that of the first embodiment, except that in the third embodiment, each of the lower contacts 32 further includes a third lower contact 326.

Figure 8:
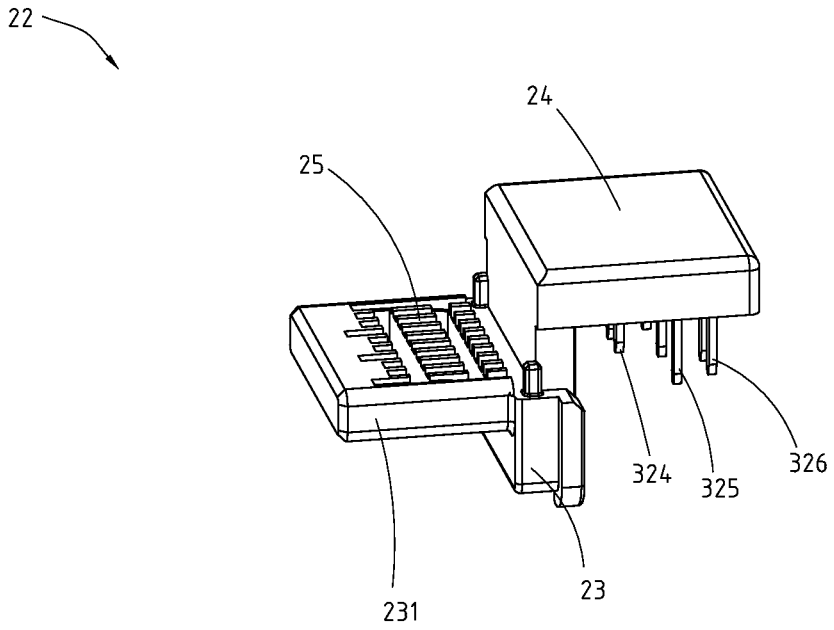
FIG. 8 is a perspective view of a connector receptacle where a metal shell is eliminated from the connector receptacle and formed in a fourth exemplary embodiment according to the present invention.
Figure 9:
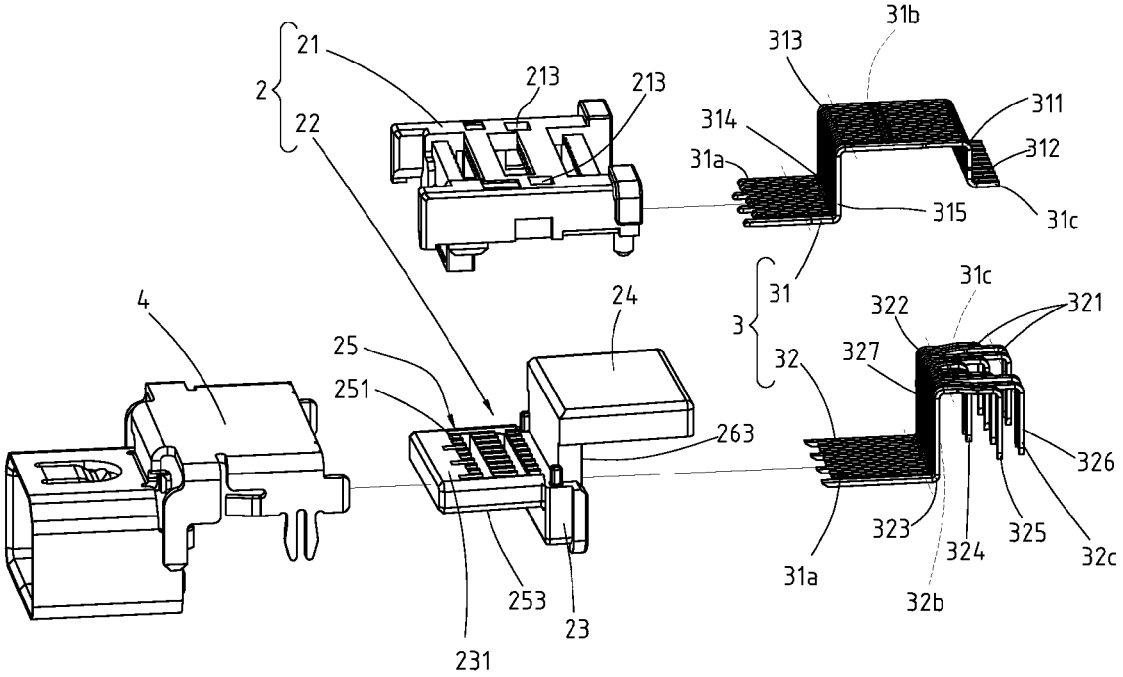
FIG. 9 is an exploded view of the connector receptacle formed in the fourth exemplary embodiment according to the present invention.

Please refer to FIG. 8 and FIG. 9, which are a perspective view of a connector receptacle 20 formed in a fourth exemplary embodiment and an exploded view of the connector receptacle 20 formed in a fourth exemplary embodiment according to the present invention. As shown in FIG. 8 and FIG. 9, the connector receptacle 20 of this embodiment is approximately the same as that of the third exemplary embodiment, except that in the fourth exemplary embodiment, each of the upper contacts 31 further includes a third upper bending portion 313 and a fourth upper bending portion 314, and the lower contacts 32 further includes a second lower bending portion 322 and a third lower bending portion 323, such that an upper connecting portion 315 is defined between the third upper bending portion 313 and the fourth upper bending portion 314. In addition, each of the lower contacts 32 further includes a second lower bending portion 322 and the third lower bending portion 323.

The disclosure has following advantages.

Firstly, the disclosure stabilizes the transmitting signals of the electronic device therewith, and the electronic characteristics of the disclosure meet the requirements.

Secondly, the disclosure reduces the difficulty of the manufacturing processes and the manufacturing costs.

Thirdly, the disclosure has a modular design so that the disclosure has high community between different electronic devices.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A connector receptacle, comprising:

an insulator, comprising:

a first insulator; and a second insulator, comprising:

a base portion;

a positioning portion, extending backwardly from the base portion in a front-to-rear direction; and a tongue plate, extending forwardly from the base portion in a rear-to-front direction, wherein the tongue plate defines a plurality of first contact locations disposed on a top side of the tongue plate and second contact locations disposed on a bottom side of the tongue plate; and a plurality of contacts, comprising:

a plurality of upper contacts, wherein each of the upper contacts comprises a contact portion, a connection portion, and a soldering portion and each contact portion of the upper contacts is located at the corresponding first contact location; and a plurality of lower contacts, wherein each of the lower contacts comprises a contact portion, a connection portion, and a soldering portion and each contact portion of the lower contacts is located at the corresponding second contact location, wherein the connection portions of the upper contacts are held by the first insulator and insert-molded in the first insulator, the connection portions of the lower contacts are held by the base portion and insert-molded in the base portion, and the partial soldering portions of the lower contacts are held by the positioning portion and insert-molded in the positioning portion such that the soldering portions of the lower contacts are guided to be inserted into the corresponding through holes defined in a circuit board; and a metal shell surrounding the insulator.

2. The connector receptacle according to claim 1, wherein each of the upper contacts comprises a first upper bending portion and a second upper bending portion.

3. The connector receptacle according to claim 2, wherein each of the upper contacts further comprises a third upper bending portion and a fourth upper bending portion.

4. The connector receptacle according to claim 1, wherein each of the lower contacts further comprises a first lower bending portion.

5. The connector receptacle according to claim 4, wherein each of the lower contacts further comprises a second lower bending portion and a third lower bending portion.

6. The connector receptacle according to claim 1, wherein each of the lower contacts further comprises a first set of lower soldering portions and a second set of lower soldering portions, which are two parallel rows of electrical soldering portions.

7. The connector receptacle according to claim 6, wherein each of the lower contacts further comprises a third lower contact.

8. The connector receptacle according to claim 6, wherein the soldering portions of the lower contacts are secured to the circuit board by inserting the soldering portions of the first set of lower soldering portions and the soldering portions of the second set of lower soldering portions through holes in the circuit board and soldering the soldering portions in place by through hole technology.

9. The connector receptacle according to claim 1, wherein the base portion, the tongue plate and the positioning portion are integrally injection molded for production of an unitary member.

10. The connector receptacle according to claim 1, wherein the soldering portions of the upper contacts are mounted onto the surface of the circuit board by surface mount technology.

11. The connector receptacle according to claim 1, wherein the connector receptacle is a Mini DisplayPort connector receptacle.

* * * * *